US011905778B2

(12) United States Patent
Batarseh et al.

(10) Patent No.: US 11,905,778 B2
(45) Date of Patent: Feb. 20, 2024

(54) DOWNHOLE LASER TOOL AND METHODS

(71) Applicant: SAUDI ARABIAN OIL COMPANY, Dhahran (SA)

(72) Inventors: Sameeh Issa Batarseh, Dhahran Hills (SA); Damian Pablo San Roman Alerigi, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 416 days.

(21) Appl. No.: 17/182,568

(22) Filed: Feb. 23, 2021

(65) Prior Publication Data

US 2022/0268121 A1 Aug. 25, 2022

(51) Int. Cl.
*E21B 31/16* (2006.01)

(52) U.S. Cl.
CPC ..... *E21B 31/16* (2013.01)

(58) Field of Classification Search
CPC ..... E21B 31/16; E21B 31/18
See application file for complete search history.

(56) References Cited

U.S. PATENT DOCUMENTS

| | | | |
|---|---|---|---|
| 3,871,485 | A | 3/1975 | Keenan, Jr. |
| 6,755,262 | B2 | 6/2004 | Parker |
| 6,888,097 | B2 | 5/2005 | Batarseh |
| 9,926,758 | B1 | 3/2018 | Adkins et al. |
| 10,301,912 | B2 * | 5/2019 | De Witt ..... B08B 7/0042 |
| 2010/0044105 | A1 | 2/2010 | Faircloth et al. |
| 2014/0090846 | A1 | 4/2014 | Deutch et al. |

FOREIGN PATENT DOCUMENTS

| | | | |
|---|---|---|---|
| CN | 203081295 | U | 7/2013 |
| CN | 203334954 | U | 12/2013 |
| WO | 2014031116 | A1 | 2/2014 |
| WO | 2019117868 | A1 | 6/2019 |
| WO | 2019117871 | A1 | 6/2019 |

OTHER PUBLICATIONS

International Search Report and Written Opinion issued in Application No. PCT/US2022/017525, dated Apr. 19, 2022 (11 pages).

* cited by examiner

*Primary Examiner* — Matthew R Buck
(74) *Attorney, Agent, or Firm* — Osha Bergman Watanabe & Burton LLP

(57) ABSTRACT

A laser system for freeing downhole equipment includes a laser tool having an inner diameter larger than an outer diameter of the downhole equipment and a means for generating a ring-shaped collimated laser beam. The laser system further includes a work string with the inner diameter larger than the outer diameter of the downhole equipment. The laser tool is installed on the work string and the work string is lowered around the downhole equipment. Upon lowering the work string to a position in which the laser tool is located proximate to an obstruction of the downhole tool, the laser tool emits the ring-shaped collimated laser beam so as to clear out an annulus space between the downhole equipment and a wellbore wall in order to free the downhole equipment.

20 Claims, 8 Drawing Sheets

DOWNHOLE LASER TOOL AND METHODS

BACKGROUND

Hydrocarbon fluids are often found in hydrocarbon reservoirs located in porous rock formations below the earth's surface. Hydrocarbon wells may be drilled to extract the hydrocarbon fluids from the hydrocarbon reservoirs. Hydrocarbon wells may be drilled by running a drill string, comprised of a drill bit and a bottom hole assembly, into a wellbore to break the rock and extend the depth of the wellbore. A fluid may be pumped through the drill bit to help cool and lubricate the drill bit, provide bottom hole pressure, and carry cuttings to the surface. In drilling operations, the drill string may become stuck. A stuck drill string, commonly called "stuck pipe", occurs when the drill string cannot be moved up or down the wellbore without excessive force being applied. Often, when trying to free the stuck pipe, a portion of the drill string may be broken off and left in the wellbore. This portion of the drill string is called a fish, and a fishing operation may be needed to retrieve the fish from the wellbore.

Various types of tools, such as jars and overshot tools, are used to try and free the stuck pipe as well as retrieve the fish. Jars are mechanical devices that deliver an impact load to the portion of the drill string that is stuck. Overshot tools, commonly run in tandem with a crude drilling surface that allows the overshot tool to be lightly drilled over the stuck pipe, may grab onto the fish in order to pull the fish from the wellbore.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

The present disclosure presents, in one or more embodiments, a laser system for freeing downhole equipment and a method to operate the system. In general, in one or more embodiments, the laser system includes a laser tool having an inner diameter larger than an outer diameter of the downhole equipment and a means for generating a ring-shaped collimated laser beam. The laser system further includes a work string with the inner diameter larger than the outer diameter of the downhole equipment. The laser tool is installed on the work string and the work string is lowered around the downhole equipment. Upon lowering the work string to a position in which the laser tool is located proximate to an obstruction of the downhole tool, the laser tool emits the ring-shaped collimated laser beam so as to clear out an annulus space between the downhole equipment and a wellbore wall in order to free the downhole equipment.

In one or more embodiments, a method for operating the laser system includes installing a laser tool, the laser tool having means for generating a ring-shaped collimated laser beam, onto a work string. The laser tool and the work string have an inner diameter larger than an outer diameter of the downhole equipment. The work string and the laser tool are lowered over the downhole equipment to a position located proximate to an obstruction of the downhole tool. The ring-shaped collimated laser beam is generated and emitted into an annulus between the downhole equipment and a wellbore wall so as to clear out the obstruction, and the work string and the laser tool are pulled out of the wellbore.

Other aspects and advantages of the claimed subject matter will be apparent from the following description and the appended claims.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1:
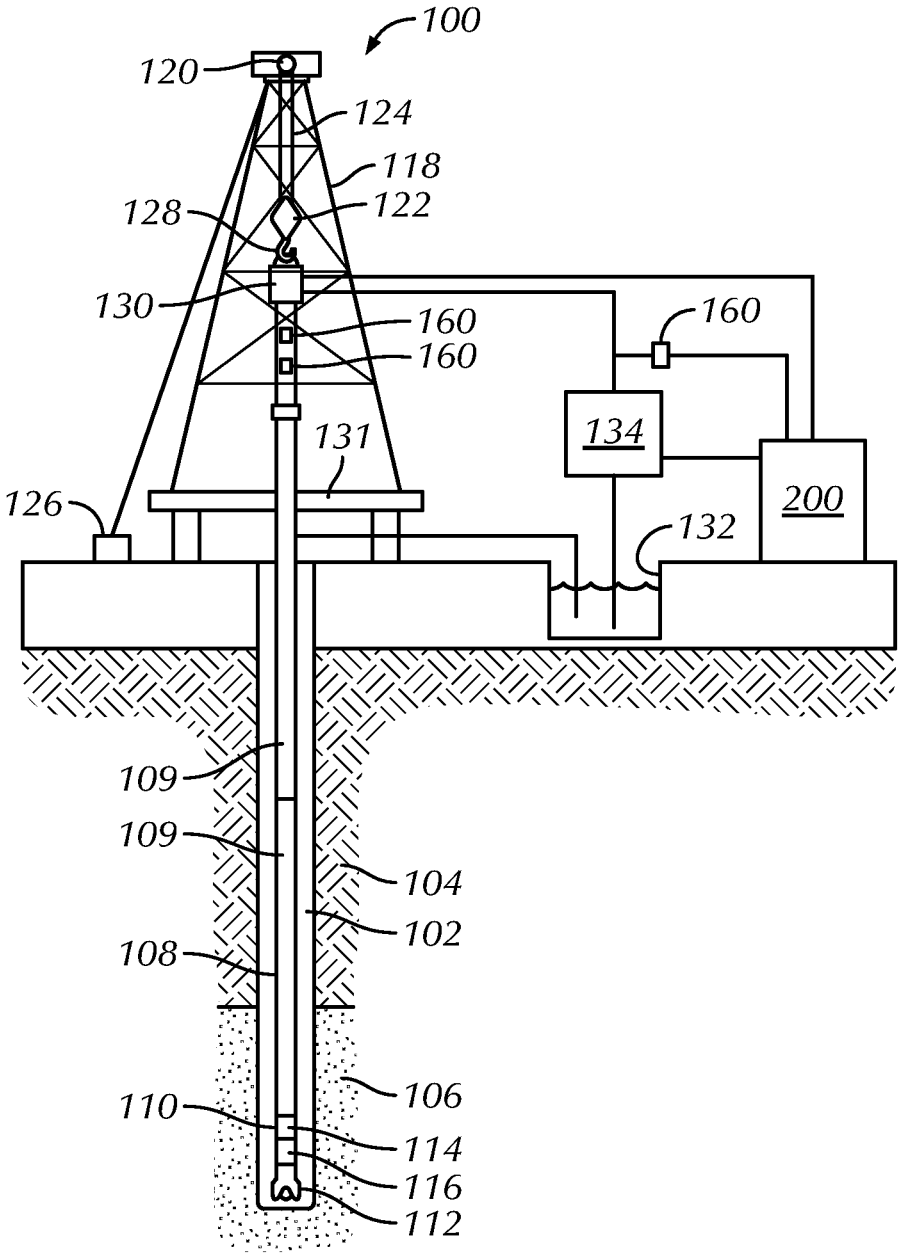
FIG. 1 is a schematic diagram of an exemplary well site in accordance with one or more embodiments.

FIG. 1 illustrates an exemplary well site (100). In general, well sites may be configured in a myriad of ways. Therefore, well site (100) is not intended to be limiting with respect to the particular configuration of the drilling equipment. The well site (100) is depicted as being on land. In other examples, the well site (100) may be offshore, and drilling may be carried out with or without use of a marine riser. A drilling operation at well site (100) may include drilling a wellbore (102) into a subsurface including various formations (104, 106). For the purpose of drilling a new section of wellbore (102), a drill string (108) is suspended within the wellbore (102). The drill string (108) may include one or more drill pipes (109) connected to form conduit and a bottom hole assembly (BHA) (110) disposed at the distal end of the conduit. The BHA (110) may include a drill bit (112) to cut into the subsurface rock. The BHA (110) may include measurement tools, such as a measurement-while-drilling (MWD) tool (114) and logging-while-drilling (LWD) tool 116. Measurement tools (114, 116) may include sensors and hardware to measure downhole drilling parameters, and these measurements may be transmitted to the surface using any suitable telemetry system known in the art.

The BHA (110) and the drill string (108) may include other drilling tools known in the art but not specifically shown.

The drill string (108) may be suspended in wellbore (102) by a derrick (118). A crown block (120) may be mounted at the top of the derrick (118), and a traveling block (122) may hang down from the crown block (120) by means of a cable or drilling line (124). One end of the cable (124) may be connected to a drawworks (126), which is a reeling device that can be used to adjust the length of the cable (124) so that the traveling block (122) may move up or down the derrick (118). The traveling block (122) may include a hook (128) on which a top drive (130) is supported. The top drive (130) is coupled to the top of the drill string (108) and is operable to rotate the drill string (108). Alternatively, the drill string (108) may be rotated by means of a rotary table (not shown) on the drilling floor (131). Drilling fluid (commonly called mud) may be stored in a mud pit (132), and at least one pump (134) may pump the mud from the mud pit (132) into the drill string (108). The mud may flow into the drill string (108) through appropriate flow paths in the top drive (130) (or a rotary swivel if a rotary table is used instead of a top drive to rotate the drill string (108)).

In one implementation, a system (200) may be disposed at or communicate with the well site (100). The system (200) may control at least a portion of a drilling operation at the well site (100) by providing controls to various components of the drilling operation. In one or more embodiments, system (200) may receive data from one or more sensors (160) arranged to measure controllable parameters of the drilling operation. As a non-limiting example, sensors (160) may be arranged to measure WOB (weight on bit), RPM (drill string rotational speed), GPM (flow rate of the mud pumps), and ROP (rate of penetration of the drilling operation). Sensors (160) may be positioned to measure parameter(s) related to the rotation of the drill string (108), parameter(s) related to travel of the traveling block (122), which may be used to determine ROP of the drilling operation, and parameter(s) related to flow rate of the pump (134). For illustration purposes, sensors (160) are shown on drill string (108) and proximate mud pump (134). The illustrated locations of sensors (160) are not intended to be limiting, and sensors (160) could be disposed wherever drilling parameters need to be measured. Moreover, there may be many more sensors (160) than shown in FIG. 1 to measure various other parameters of the drilling operation. Each sensor (160) may be configured to measure a desired physical stimulus.

During a drilling operation at the well site (100), the drill string (108) is rotated relative to the wellbore (102), and weight is applied to the drill bit (112) to enable the drill bit (112) to break rock as the drill string (108) is rotated. In some cases, the drill bit (112) may be rotated independently with a drilling motor. In further embodiments, the drill bit (112) may be rotated using a combination of the drilling motor and the top drive (130) (or a rotary swivel if a rotary table is used instead of a top drive to rotate the drill string (108)). While cutting rock with the drill bit (112), mud is pumped into the drill string (108). The mud flows down the drill string (108) and exits into the bottom of the wellbore (102) through nozzles in the drill bit (112). The mud in the wellbore (102) then flows back up to the surface in an annular space between the drill string (108) and the wellbore (102) with entrained cuttings. The mud with the cuttings is returned to the pit (132) to be circulated back again into the drill string (108). Typically, the cuttings are removed from the mud, and the mud is reconditioned as necessary, before pumping the mud again into the drill string (108). In one or more embodiments, the drilling operation may be controlled by the system (200).

Figure 2:
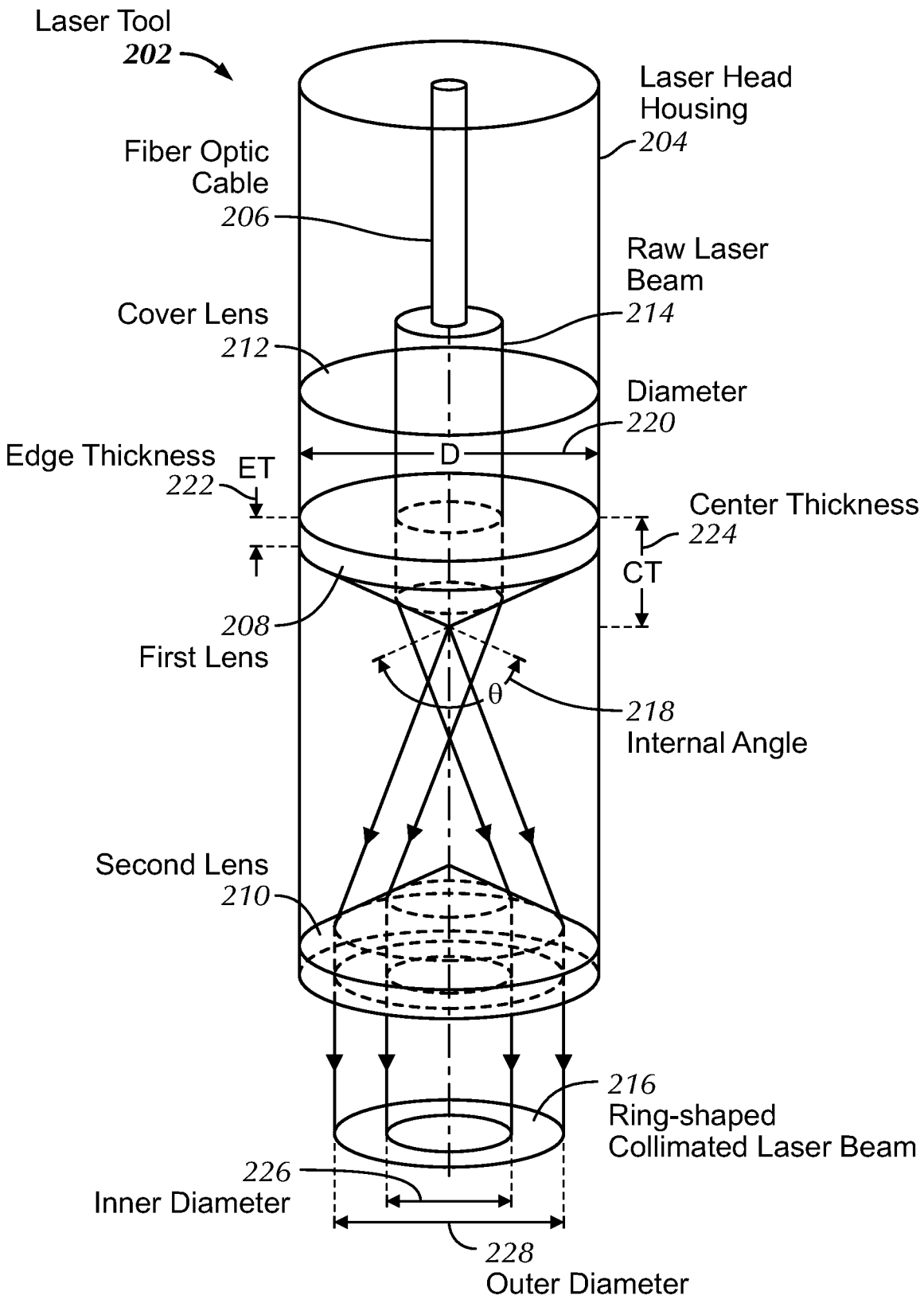
FIG. 2 is a schematic diagram of a downhole laser tool in accordance with one or more embodiments.

FIG. 2 depicts, in one or more embodiments, a proposed configuration of a laser tool (202) apparatus comprising a laser head housing (204), a fiber optic cable (206), a first lens (208), a second lens (210), and a cover lens (212). The laser head housing (204) houses and protects the fiber optic cable (206), the first lens (208), the second lens (210), and the cover lens (212). The cover lens (212) protects the first lens (208) and the second lens (210) from splatter and debris during the laser process. The fiber optic cable (206) produces a raw laser beam (214) that enters into the first lens (208) which focuses and controls the shape of the beam. The raw laser beam (214) enters the second lens (210) to produce a ring-shaped collimated laser beam (216).

The first lens (208) and the second lens (210) may be conic lenses of a particular internal angle (218), diameter (220), edge thickness (222), and center thickness (224). The first lens (208) and the second lens (210) have a particular aspect ratio which is the ratio of the lenses' (208, 210) center thickness (224) to diameter (220). The aspect ratio and internal angle (218) of the first lens (208) and the second lens (210) determine the inner diameter (226) of the ring-shaped collimated laser beam (216), the outer diameter (228) of the ring-shaped collimated laser beam (216), and the eccentricity of the ring-shaped collimated laser beam (216).

The eccentricity of the ring-shaped collimated laser beam (216) may be a circle, parabola, or elliptical transversal beam profile. The diameter (220) of the lenses (208, 210) should be a value between 1.1 times the outer diameter (228) of the ring-shaped collimated laser beam (216) and 1.9 times the inner diameter of the laser tool (202). The outer diameter (228) of the ring-shaped collimated laser beam (216) is given by Equation 1 (below) where $D_{OD\ beam}$=the outer diameter (228) of the ring-shaped collimated laser beam (216); L=the distance between the tips of both lenses (208, 210) where $$L \geq \frac{R}{(n-1)\alpha};$$

R=radius of the lenses (208, 210);

$$\alpha = \frac{\theta - \pi}{2};$$

θ=the internal angle (218); n=the effective refractive index of the lenses (208, 210)

$$D_{ODbeam} = 2L\left(\frac{\sin(\alpha)\left(n\cos(\alpha) - \sqrt{1-n^2\sin(\alpha)}\right)}{n\sin^2(\alpha) + \cos(\alpha)\sqrt{1-n^2\sin^2(\alpha)}}\right) \quad \text{Equation (1)}$$

To achieve collimation of the raw laser beam (214), the internal angle (218) of the first lens (208) and the second lens (210) must be the same. In addition, the lenses (208, 210) may be a reflection, such as depicted in FIG. 2, the lenses (208, 210) may also be reflected in the opposite direction from what is depicted. The edge thickness may be any thickness, but the edge thickness is commonly between 1 mm and 10 mm. Equation 2 (below) shows the relationship between the center thickness (224)=CT, edge thickness (222)=ET, diameter (220)=D, and internal angle (218)=θ of the lenses (208, 210).

$$CT = ET + \frac{D}{2}\cot\left(\frac{\theta}{2}\right) \quad \text{Equation (2)}$$

The thickness of the ring-shaped collimated laser beam (216) is a lateral distance between the outer diameter (228) and the inner diameter (226) of the ring-shaped collimated laser beam (216). The thickness is determined using Equation 3 (below) where BT=thickness of the ring-shaped collimated laser beam (216);

$$R_{beam} = \frac{D_{ODbeam}}{2};$$

n=the effective refractive index of the lenses (208, 210);

$$\alpha = \frac{\theta - \pi}{2};$$

θ=the internal angle (218).

$$BT = \frac{R_{beam}\sqrt{1 - n^2\sin^2(\alpha)}}{\cos(\alpha)\left(n\sin^2(\alpha) + \cos(\alpha)\sqrt{1 - n^2\sin^2(\alpha)}\right)} \quad \text{Equation (3)}$$

In further embodiments, an aspheric or spherical lens may be positioned between the first lens (208) and the second lens (210) or after the second lens (210) to reduce the thickness of the ring-shaped collimated laser beam (216). When the aspheric or spherical lens is positioned between the first lens (208) and the second lens (210), the ring-shaped collimated laser beam is reduced up to the diffraction limit of the aspheric or spherical lens. When the aspheric or spherical lens is positioned after the second lens (210), the ring-shaped collimated laser beam is thinned and focused and is not relied on the diffraction limit of the aspheric or spherical lens.

The second lens (210) may be transformed into a switchable mirror or glass using electro-optical glazing, electrochromic materials, or non-Hermitian materials to yield perfect transparency or reflectance. A conic switchable mirror/glass with flat surfaces may also be placed after the second lens (210) to reflect the ring-shaped collimated laser beam (216) in an outward direction radially away from the laser tool (202), however the energy density of the ring-shaped collimated laser beam (216) would decrease. A conic switchable mirror/glass with a hyperbolic surface would keep a higher energy density while still reflecting the ring-shaped collimated laser beam (216) in an outward direction radially away from the laser tool (202).

Those skilled in the art will appreciate that the methods of producing a ring-shaped collimated laser beam (216) noted above are in no way limiting to the scope of this disclosure. Any suitable method of producing a ring-shaped collimated laser beam, such as using static/dynamic refractive/diffractive elements, transformation optical devices, or micro/macro patterned windows/mirrors, may be used without departing from the scope of this disclosure herein.

Figure 3:
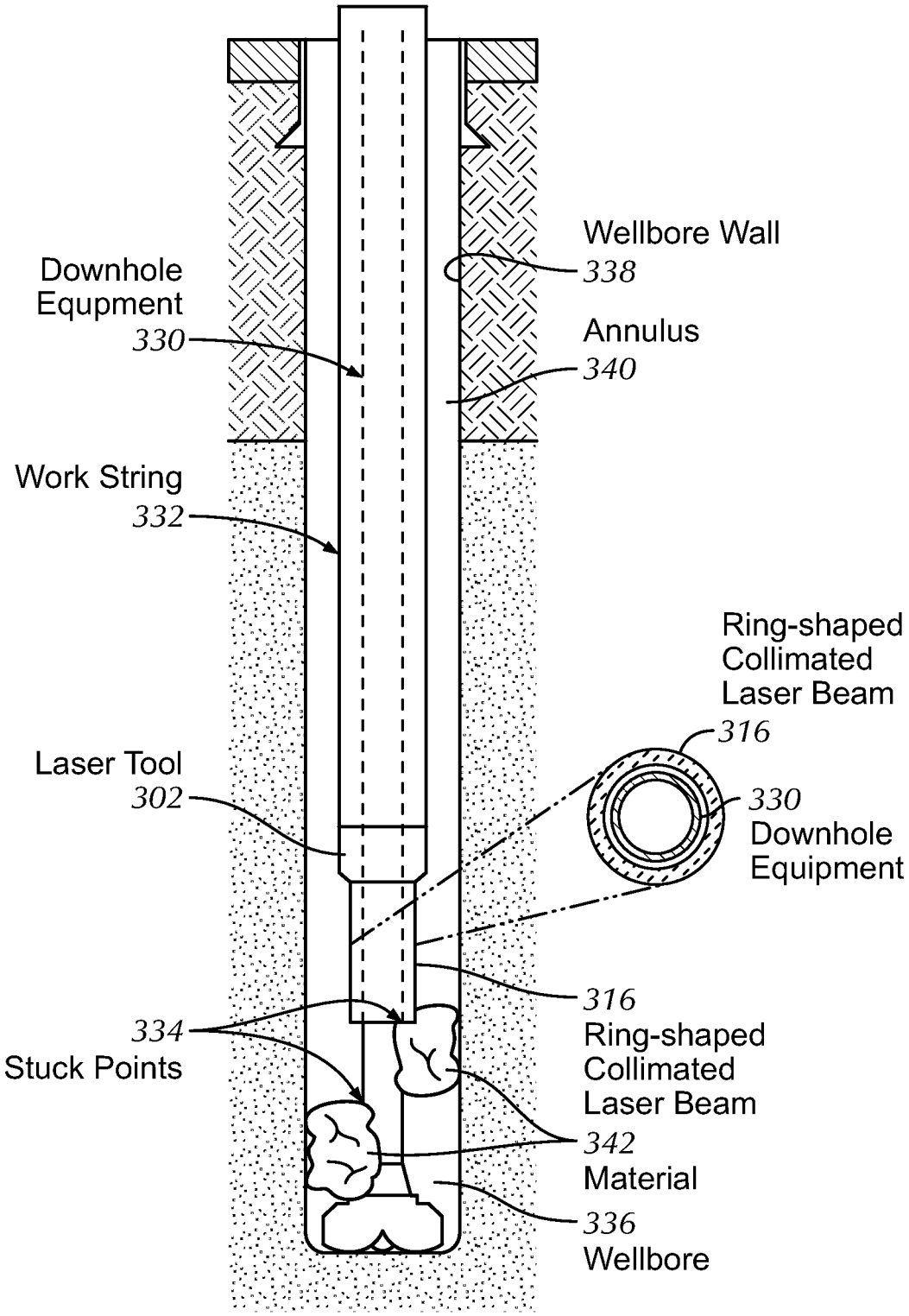
FIG. 3 is a schematic diagram of a laser system in accordance with one or more embodiments.

FIG. 3 depicts the laser tool (302) deployed in a wellbore (336) to free stuck pipe. In one or more embodiments, the downhole equipment (330) is stuck at a plurality of stuck points (334). The downhole equipment (330) may be a drill string (108) as depicted in FIG. 3, or the downhole equipment (330) may be any equipment that may be used for any operation performed in a wellbore (336) such as a completions string, a production string, casing, or any type of tubular or tool. The stuck points (334) are depicted as being located around the bottom hole assembly (110) of a drill string (108), however, the stuck points (334) may occur at any location along the downhole equipment (330). FIG. 3 depicts the stuck points (334) as being caused by material (342). The material (342) that may be causing the stuck points (334) may comprise cuttings, wall cavings, or tools that have been broken or lost in the wellbore (336). However, in further embodiments, the stuck points (334) may be cause by irregularities of the wellbore wall (338). Wellbore wall (338) irregularities may be an inconsistent inner diameter or portions of the wellbore wall (338) protruding or jutting into the wellbore (336).

The laser tool (302) is run in the wellbore (336) by a work string (332). The inner diameter of the work string (332) and laser tool (302) is larger than the outer diameter of the downhole equipment (330) such that the work string (332) and laser tool (302) are lowered around the downhole equipment (330). The laser tool (302) emits the ring-shaped collimated laser beam (316) to clear material (342), or wellbore wall (338) irregularities, from the annulus (340) space between the downhole equipment (330) and the wellbore wall (338) in order to remove the obstructions and free the downhole equipment (330). The inner diameter (226) of the ring-shaped collimated laser beam (316) is larger than the outer diameter of the downhole equipment (330) such that the ring-shaped collimated laser beam (316) may run parallel to the downhole equipment (330) without damaging the downhole equipment (330).

Figure 4:
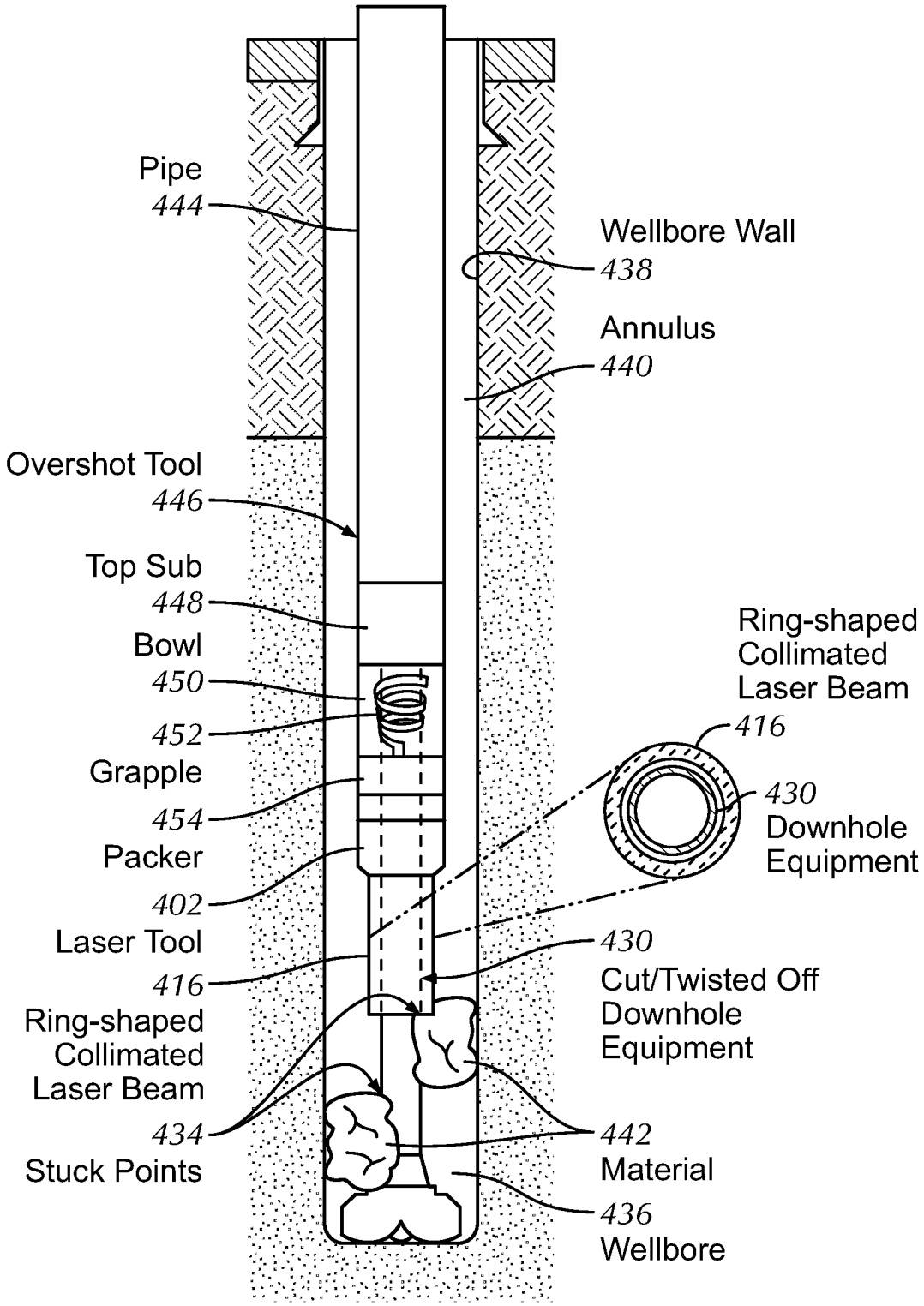
FIG. 4 is a schematic diagram of a laser system in accordance with one or more embodiments.

FIG. 4 depicts the laser tool (402) deployed in a wellbore (436) to free stuck downhole equipment (430). In one or more embodiments, the downhole equipment (430) is stuck at a plurality of stuck points (434) and the downhole equipment (430) has been broken or twisted off. The laser tool (402) is run in the wellbore (436) by an overshot tool (446). Overshot tools (446) are used to retrieve a fish from a wellbore (436) and are commonly configured with a top sub (448), a bowl (450), a grapple (452), and a packer (454). The top sub (448) is the uppermost component of the overshot tool (446) and is equipped with a box connection to connect to the pipe (444) used to trip the overshot tool (446) into the wellbore (436). The bowl (450) is the major working component of the overshot tool (446). The inside diameter of the bowl (450) features a threaded section that conforms to the exterior threads of the grapple (452).

The grapple (452) is the gripping mechanism of the overshot tool (446) and the grapple (452) may be a basket grapple (452) or a spiral grapple (452). A basket grapple (452) is a slotted, expandable cylinder with a wickered interior to engage the fish. The basket grapple (452) engages the fish by passing over the fish, and, when a pull load is applied, the grapple (452) bites into the fish using the wickers. A spiral grapple (452) is similar to a left hand coil spring. Its outside diameter has a taper form which mates with the left hand scroll taper in the bowl (450). Left hand helical serrations in the bore provide the catch wickers. The spiral grapple (452) engages the fish by rotating over the fish in a specific direction, and, when a pull load is applied, the grapple (452) bites into the fish to form a grip that may pull the fish from the wellbore (436).

A type A packer (454) is used with the spiral grapple (452) and seals against the inside of the bowl (450) and around the outside of the fish. A mill control packer (454) is used with the basket grapple (452) and is used to provide a positive seal around the fish and remove small burrs. A burr is a raised edge or small piece of material that remains attached to a work piece after a modification process. In one or more embodiments, the overshot tool (446) and laser tool (402) may trip into the wellbore (436) by passing over the downhole equipment (430). The laser tool (402) may emit the ring-shaped collimated laser beam (416) to clear out the annulus (440), between the downhole equipment (430) and the wellbore wall (436), of material (442) to remove the obstructions. The overshot tool (446) may be engaged and the fish may be pulled out of the wellbore (436).

Figure 5:
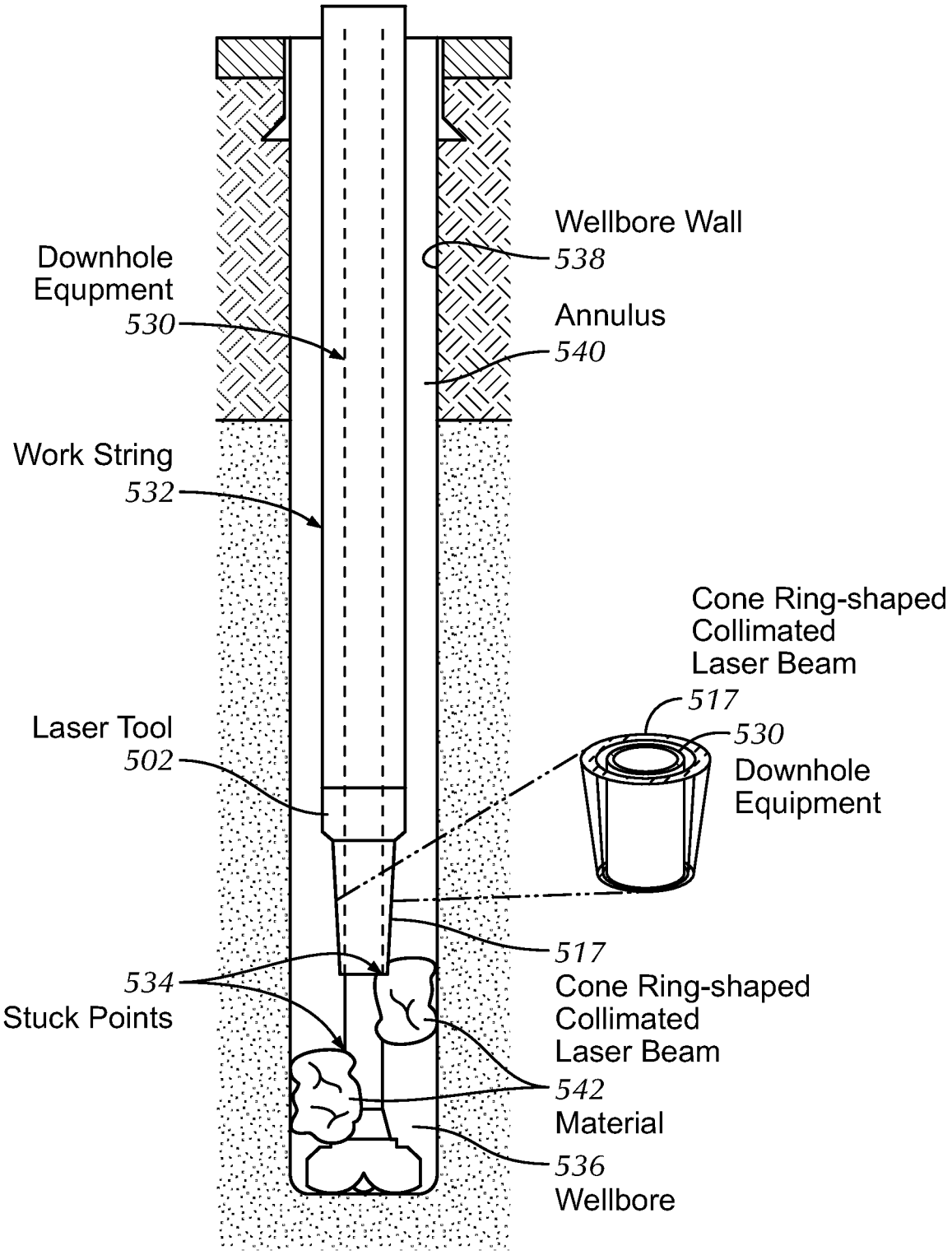
FIG. 5 is a schematic diagram of a laser system in accordance with one or more embodiments.

FIG. 5, in one or more embodiments, depicts the laser tool (502) configured to cut downhole equipment (530). The laser tool (502) is run into the wellbore (536) by a work string (532). In this depiction, the downhole equipment (530) is stuck in the wellbore (536) at a number of stuck points (534). The material (542) in the wellbore (536) has packed off the downhole equipment (530) to create the stuck points (534). The work string (532) and laser tool (502) may be tripped into the wellbore (536) by passing over and encompassing the downhole equipment (530). The laser tool (502) may emit a cone ring-shaped collimated laser beam (517) and direct the laser beam (516) onto the downhole equipment (530). The cone ring-shaped collimated laser beam (517) may cut the downhole equipment (530) above the stuck points (534) in order to pull the detached portion of the downhole equipment (530) out of the wellbore (536).

Upon removal of the cut downhole equipment (530), the remaining downhole equipment (530), or the fish, may be freed by conventional fishing methods or by running the laser system of FIG. 3 or 4. The fish may be left in the wellbore (536) and the well may be abandoned. The wellbore (536) may be plugged and the drilling operation may produce a sidetracked well from the original wellbore (536). The laser system, as depicted in FIG. 5, may be run into the wellbore (536) by the overshot tool (446) introduced in FIG. 4. The laser system of FIG. 5 may run the ring-shaped collimated laser beam (216, 316, 416) laser tool in tandem with the laser tool (502), depicted in FIG. 5, so the annulus (540), between the downhole equipment (530) and wellbore wall (538), may be cleared of materials (542) prior to or after the detached portion of the downhole equipment (530) has been removed from the wellbore (536).

Figure 6:
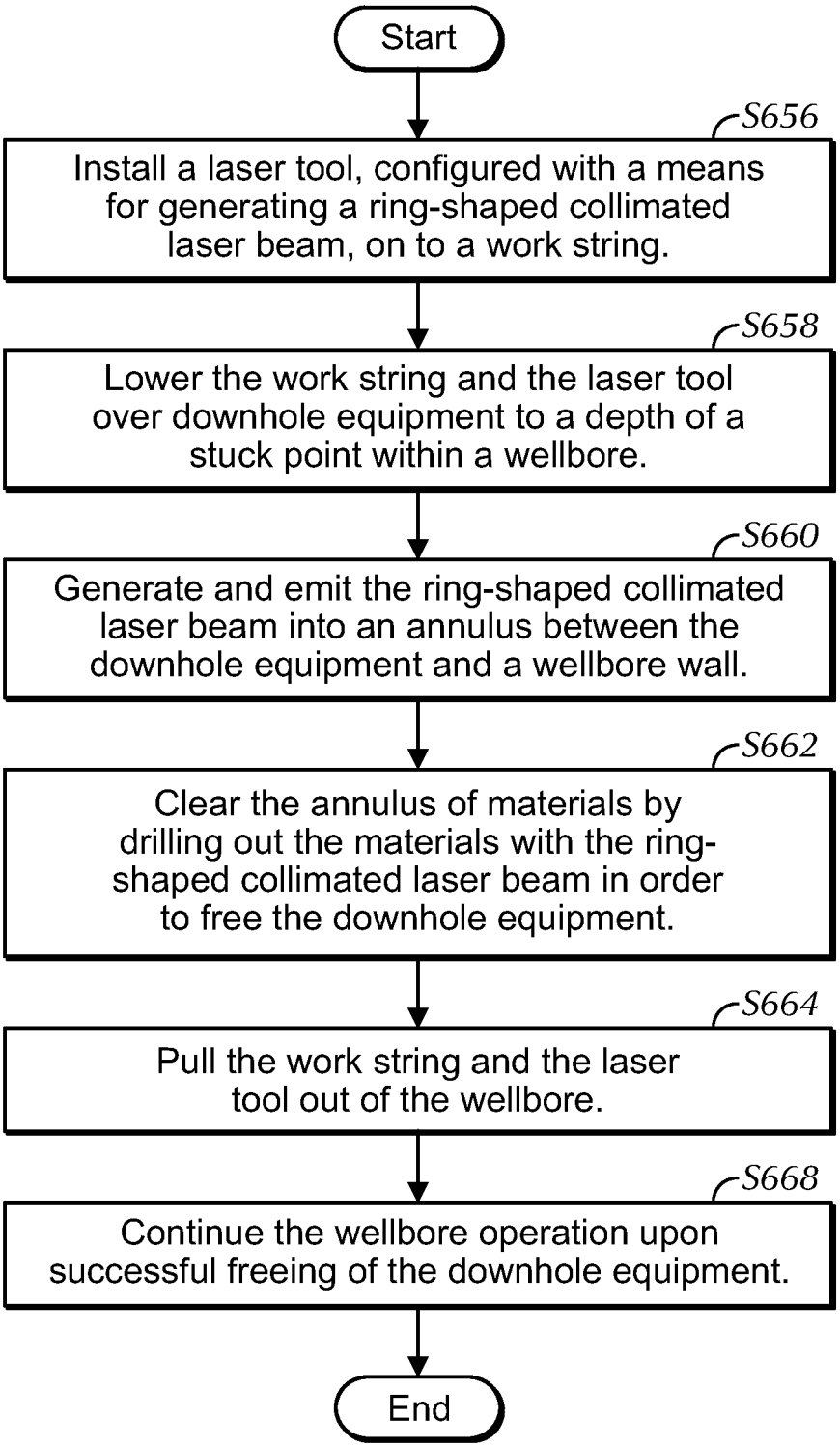
FIG. 6 shows a flowchart in accordance with one or more embodiments.

FIG. 6 depicts, in accordance with one or more embodiments, a flow chart for utilizing a laser system. While the various blocks in FIG. 6 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

A laser tool (202, 302, 402, 502), configured with a means for generating a ring-shaped collimated laser beam (216, 316, 416), is installed in a work string (332, 532) (S656). The work string (332, 532) may be comprised of any pipe (444) that can be used in conditions experienced downhole, such as drill pipe (444). The means for generating a ring-shaped collimated laser beam (216, 316, 416) may comprise a method that uses a fiber optic cable (206), a first conic lens (208), and a second conic lens (210).

The fiber optic cable (206) emits a raw laser beam (214) into the first conic lens (208) which focuses and controls the shape of the beam. The diverging laser beam enters the second lens (210) to produce the ring-shaped collimated laser beam (216, 316, 416). The inner diameter (226), outer diameter (228), and eccentricity of the ring-shaped collimated laser (216, 316, 416) may be changed depending on the internal angle (218) and aspect ratio of the conic lenses (210, 212). Any means of producing a ring-shaped collimated laser beam (216, 316, 416) may be used herein without departing from the scope of this disclosure.

For the method depicted in FIG. 6, the collimated ring shaped laser beam (216, 316, 416) has an inner diameter (226) larger than the outer diameter of the downhole equipment (330, 430, 530), so, when the ring-shaped collimated laser beam (216, 316, 416) is emitted, the downhole equipment (330, 430, 530) is unharmed. The work string (332, 532) and the laser tool (202, 302, 402, 502) have inner diameters larger than the outer diameter of the downhole equipment (330, 430, 530) such that the work string (332, 532) and laser tool (202, 302, 402, 502) are lowered over the downhole equipment (330, 430, 530), using the top drive (130), to a depth of a stuck point (334, 434) within the wellbore (336, 436, 536) (S658).

The ring-shaped collimated laser beam (216, 316, 416) is generated by the laser tool (202, 302, 402, 502) and emitted into an annulus (340, 440, 540) between the downhole equipment (330, 430, 530) and the wellbore wall (338, 438, 538) (S660). The ring-shaped collimated laser beam (216, 316, 416) drills out the annulus (340, 440, 540) and clears the materials (342, 442, 542) that are causing the stuck points (334, 434) in order to free the downhole equipment (330, 430, 530) (S662). The material (342, 442, 542) that may be causing the stuck points (334, 434) may include cuttings, wall cavings, or tools that have been broken or lost in the wellbore (336, 436, 536).

The work string (332, 532) and the laser tool (202, 302, 402, 502) are pulled out of the wellbore (336, 436, 536) using the top drive (130) (S664). Upon successful freeing of the downhole equipment (330, 430, 530), wellbore (336, 436, 536) operations, such as drilling, workover, or completion operations may continue (S668). Upon unsuccessful freeing of the downhole equipment (330, 430, 530), other fishing operations may be performed; the wellbore (336, 436, 536) may be plugged and abandoned; or the fish may be left downhole and the wellbore (336, 436, 536) may be sidetracked.

Figure 7:
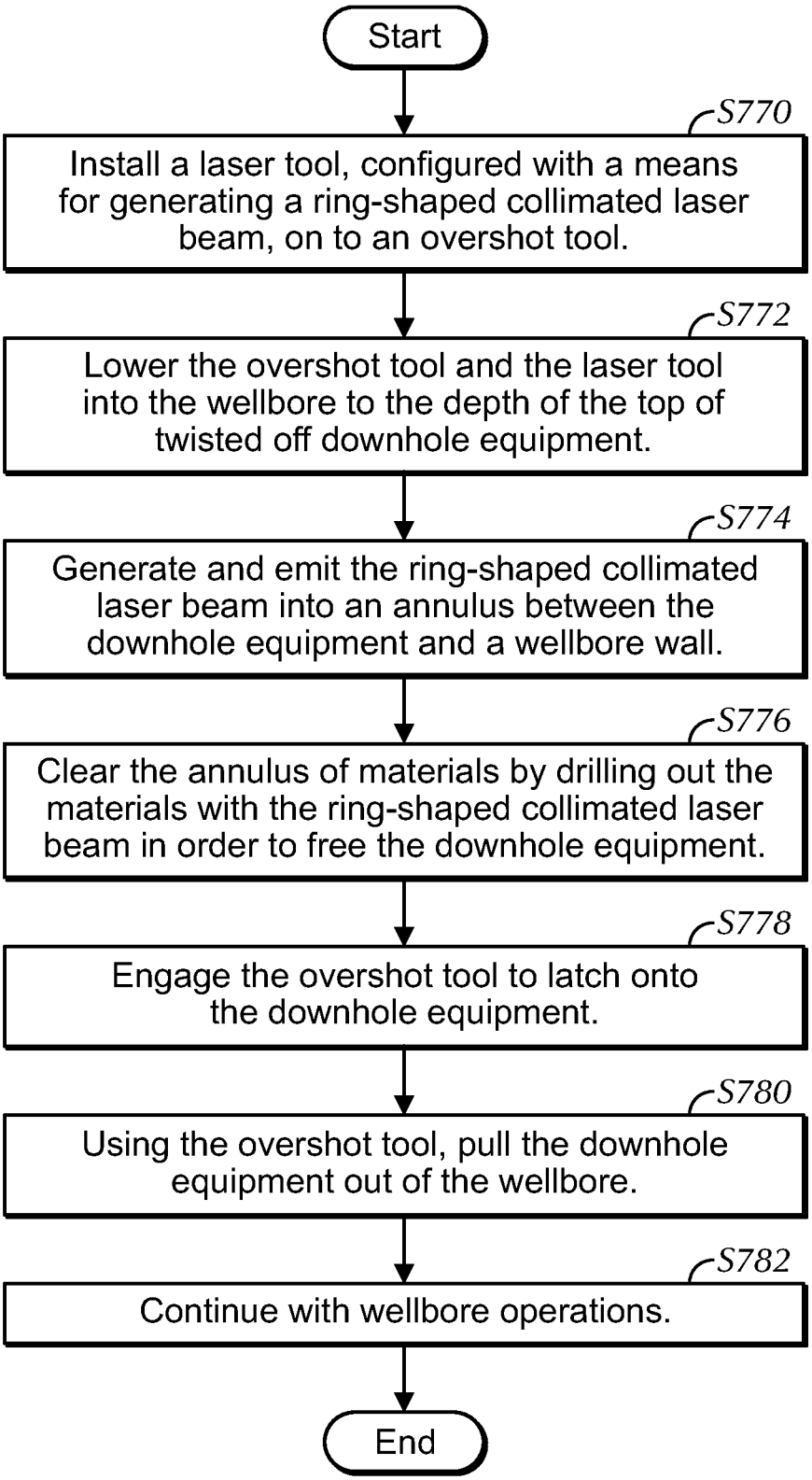
FIG. 7 shows a flowchart in accordance with one or more embodiments.

FIG. 7 depicts, in accordance with one or more embodiments, a flow chart for utilizing a laser system. While the various blocks in FIG. 7 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

A laser tool (202, 302, 402, 502), configured with a means of generating a ring-shaped collimated laser beam (216, 316, 416) is installed into an overshot tool (446) (S770). The means for generating a ring-shaped collimated laser beam (216, 316, 416) may comprise a method that uses a fiber optic cable (206), a first conic lens (208), and a second conic lens (210).

The fiber optic cable (206) emits a raw laser beam (214) into the first conic lens (208) which focuses and controls the shape of the beam. The diverging laser beam enters the second lens (210) to produce the ring-shaped collimated laser beam (216, 316, 416). The inner diameter (226), outer diameter (228), and eccentricity of the ring-shaped collimated laser (216, 316, 416) may be changed depending on the internal angle (218) and aspect ratio of the conic lenses (210, 212). Any means of producing a ring-shaped collimated laser beam (216, 316, 416) may be used herein without departing from the scope of this disclosure.

For the method depicted in FIG. 7, the collimated ring shaped laser beam (216, 316, 416) has an inner diameter (226) larger than the outer diameter of the downhole equipment (330, 430, 530), so, when the ring-shaped collimated laser beam (216, 316, 416) is emitted, the downhole equipment (330, 430, 530) is unharmed. The overshot tool (446) is a tool that may latch on to a fish and pull the fish out of the wellbore (336, 436, 536). The overshot tool (446) may be comprised of a top sub (448), a bowl (450), a grapple (452), and a packer (454). The overshot tool (446) and the laser tool (202, 302, 402, 502) are lowered into a wellbore (336, 436, 536), by a top drive (130), to meet a broken or twisted off piece of downhole equipment (330, 430, 530) that was left in the wellbore (336, 436, 536) (S772).

The overshot tool (446) and the laser tool (202, 302, 402, 502) are lowered around the downhole equipment (330, 430, 530), and the ring-shaped collimated laser beam (216, 316, 416) is generated by the laser tool (202, 302, 402, 502) and emitted into an annulus (340, 440, 540) between the downhole equipment (330, 430, 530) and a wellbore wall (338, 438, 538) (S774). The ring-shaped collimated laser beam (216, 316, 416) clears the annulus (340, 440, 540) of materials (342, 442, 542) that are packing off the downhole equipment (330, 430, 530) and causing the stuck points (334, 434) (S776). The overshot tool (446) is engaged by providing an upward force by the top drive (130). The grapple (452) latches on to the downhole equipment (330, 430, 530) (S778) and the downhole equipment (330, 430, 530) is pulled out of the wellbore (336, 436, 536) (S780).

Upon successful freeing of the downhole equipment (330, 430, 530), wellbore (336, 436, 536) operations, such as drilling, workover, or completion operations may continue (S782). Upon unsuccessful freeing of the downhole equipment (330, 430, 530), other fishing operations may be performed; the wellbore (336, 436, 536) may be plugged and abandoned; or the fish may be left downhole and the wellbore (336, 436, 536) may be sidetracked.

Figure 8:
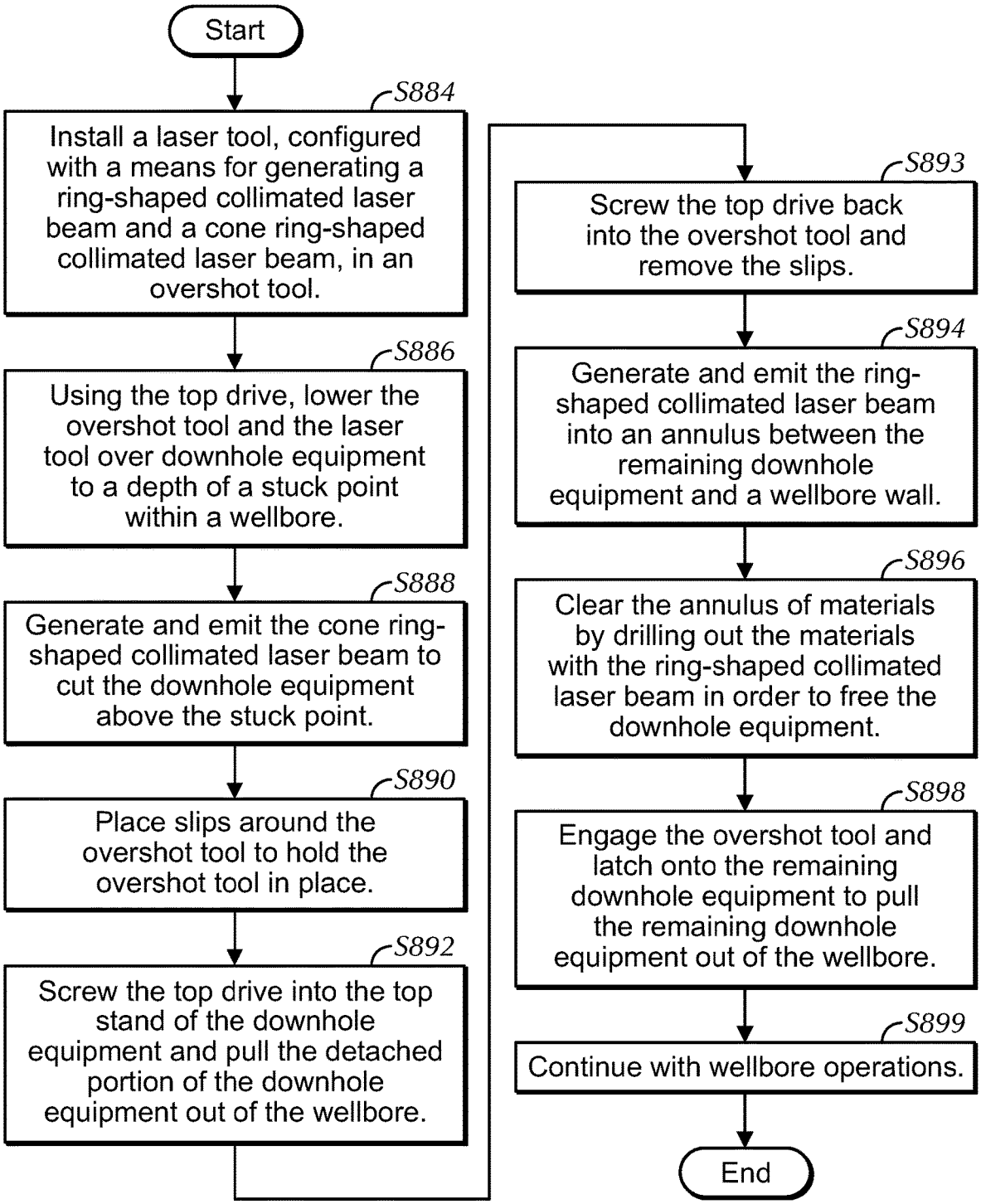
FIG. 8 shows a flowchart in accordance with one or more embodiments.

FIG. 8 depicts, in accordance with one or more embodiments, a flow chart for utilizing a laser system. While the various blocks in FIG. 8 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

A laser tool (202, 302, 402, 502), configured with a means of generating a ring-shaped collimated laser beam (216, 316, 416) and a cone ring shaped collimated laser beam (517) is installed in an overshot tool (446) (S884). The means for generating a ring-shaped collimated laser beam (216, 316, 416) may comprise a method that uses a fiber optic cable (206), a first conic lens (208), and a second conic lens (210).

The fiber optic cable (206) emits a raw laser beam (214) into the first conic lens (208) which focuses and controls the shape of the beam. The diverging laser beam enters the second lens (210) to produce the ring-shaped collimated laser beam (216, 316, 416). The inner diameter (226), outer diameter (228), and eccentricity of the ring-shaped collimated laser (216, 316, 416) may be changed depending on the internal angle (218) and aspect ratio of the conic lenses (210, 212). Any means of producing a ring-shaped collimated laser beam (216, 316, 416) may be used herein without departing from the scope of this disclosure.

For the method depicted in FIG. 8, the ring-shaped collimated laser beam (216, 316, 416) has an inner diameter (226) larger than the outer diameter of the downhole equipment (330, 430, 530), so, when the ring-shaped collimated laser beam (216, 316, 416) is emitted, the downhole equipment (330, 430, 530) is unharmed. The cone ring-shaped collimated laser beam (517) has an inner diameter and an outer diameter that decrease to a size smaller than the downhole equipment (330, 430, 530) such that the cone ring-shaped collimated laser beam (517) may cut the downhole equipment (330, 430, 530).

The overshot tool (446) is a tool that may latch on to a fish and pull the fish out of the wellbore (336, 436, 536). The overshot tool (446) may be comprised of a top sub (448), a bowl (450), a grapple (452), and a packer (454). The overshot tool (446) and the laser tool (202, 302, 402, 502) are lowered into a wellbore (336, 436, 536), by a top drive (130), over downhole equipment (330, 430, 530) to a depth of a stuck point (334, 434) within the wellbore (336, 436, 536) (S886). The cone ring-shaped collimated laser beam (517) is generated by the laser tool (202, 302, 402, 502) and emitted to cut the downhole equipment (330, 430, 530) at a point above the stuck points (334, 434) (S888).

Slips are placed around the overshot tool (446), on the drilling floor (131), to hold the weight of the overshot tool (446) (S890). The top drive (130) is screwed into the top stand of the downhole equipment (330, 430, 530) to pull the detached downhole equipment (330, 430, 530) out of the wellbore (336, 436, 536) (S892). Screw the top drive (130) back into the overshot tool (446) and remove the slips (S893). Generate the ring-shaped collimated laser beam (216, 316, 416) by the laser tool (202, 302, 402, 502) and emit the ring-shaped collimated laser beam (216, 316, 416) into an annulus (340, 440, 540) between the remaining downhole equipment (330, 430, 530) and a wellbore wall (338, 438, 538) (S894).

Clear the annulus (340, 440, 540) of materials (342, 442, 542) by drilling out the materials (342, 442, 542), that are causing the stuck points (334, 434), with the ring-shaped collimated laser beam (216, 316, 416) in order to free the downhole equipment (330, 430, 530) (S896). The overshot tool (446) is engaged by providing an upward force by the top drive (130). The grapple (452) latches on to the remaining downhole equipment (330, 430, 530) (S778) and the remaining downhole equipment (330, 430, 530) is pulled out of the wellbore (336, 436, 536) (S898).

Upon successful freeing of the downhole equipment (330, 430, 530), wellbore (336, 436, 536) operations, such as drilling, workover, or completion operations may continue (S899). Upon unsuccessful freeing of the downhole equipment (330, 430, 530), other fishing operations may be performed; the wellbore (336, 436, 536) may be plugged and abandoned; or the fish may be left downhole and the wellbore (336, 436, 536) may be sidetracked.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed:

1. A laser system for freeing downhole equipment from a wellbore comprising:

a laser tool, with an inner diameter larger than an outer diameter of the downhole equipment, the laser tool comprising means for generating a ring-shaped collimated laser beam; and a work string with an inner diameter larger than the outer diameter of the downhole equipment, wherein the laser tool is installed on the work string, wherein the work string is lowered around the downhole equipment, and wherein upon lowering the work string to a position in which the laser tool is located proximate to an obstruction of the downhole tool, the laser tool emits the ring-shaped collimated laser beam so as to clear out an annulus space between the downhole equipment and a wellbore wall in order to free the downhole equipment.

2. The laser system of claim 1, wherein the ring-shaped collimated laser beam is able to be positioned to cut the downhole equipment.

3. The laser system of claim 1, wherein the laser tool further comprises:

fiber optics;

a laser head housing;

a cover lens;

a first lens; and a second lens, wherein a raw laser beam, emitted from the fiber optics, passes through the first lens and the second lens to generate a collimated laser beam whereby the laser head housing, along with the cover lens, protects the first lens and the second lens.

4. The laser system of claim 3, wherein the means for generating the ring-shaped collimated laser beam further comprises:

the first lens being a conic lens of a particular internal angle and a particular aspect ratio; and the second lens being the conic lens of the particular internal angle and the particular aspect ratio, wherein the raw laser beam, passing through the first lens, produces a diverging ring-shaped beam and the diverging ring-shaped beam, passing through the second lens, produces the ring-shaped collimated laser beam.

5. The laser system of claim 4, wherein the particular internal angle and the particular aspect ratio determines an inner diameter of the ring-shaped collimated laser beam, an outer diameter of the ring-shaped collimated laser beam, and an eccentricity of the ring-shaped collimated laser beam.

6. The laser system of claim 1, wherein the work string is an overshot tool that latches on to the downhole equipment to be pulled out of the wellbore.

7. The laser system of claim 6, wherein the ring-shaped collimated laser beam is able to be positioned to cut the downhole equipment.

8. The laser system of claim 6, wherein the laser tool further comprises:

fiber optics;

a laser head housing;

a cover lens;

a first lens; and a second lens, wherein a raw laser beam, emitted from the fiber optics, passes through the first lens and the second lens to generate a collimated laser beam whereby the laser head housing, along with the cover lens, protects the first lens and the second lens.

9. The laser system of claim 8, wherein the means for generating the ring-shaped collimated laser beam further comprises:

the first lens being a conic lens of a particular internal angle and a particular aspect ratio; and the second lens being the conic lens of the particular internal angle and the particular aspect ratio, wherein the raw laser beam, passing through the first lens, produces a diverging ring-shaped beam and the diverging ring-shaped beam, passing through the second lens, produces the ring-shaped collimated laser beam.

10. The laser system of claim 9, wherein the particular internal angle and the particular aspect ratio determines an inner diameter of the ring-shaped collimated laser beam, an outer diameter of the ring-shaped collimated laser beam, and an eccentricity of the ring-shaped collimated laser beam.

11. A method of operating a laser system in a wellbore for freeing downhole equipment used in a wellbore operation comprising:

installing a laser tool, the laser tool comprising means for generating a ring-shaped collimated laser beam, onto a work string, wherein the laser tool and the work string have an inner diameter larger than an outer diameter of the downhole equipment;

lowering the work string and the laser tool over the downhole equipment to a position located proximate to an obstruction of the downhole tool;

generating and emitting the ring-shaped collimated laser beam into an annulus between the downhole equipment and a wellbore wall so as to clear out the obstruction; and pulling the work string and the laser tool out of the wellbore.

12. The method of claim 11, wherein the ring-shaped collimated laser beam is able to be positioned to cut the downhole equipment.

13. The method of claim 11, wherein the laser tool further comprises:

fiber optics;

a laser head housing;

a cover lens;

a first lens; and a second lens, wherein a raw laser beam, emitted from the fiber optics, passes through the first lens and the second lens to generate a collimated laser beam whereby the laser head housing, along with the cover lens, protects the first lens and the second lens.

14. The method of claim 13, wherein the means for generating the ring-shaped collimated laser beam further comprises:

the first lens being a conic lens of a particular internal angle and a particular aspect ratio; and the second lens being the conic lens of the particular internal angle and the particular aspect ratio, wherein the raw laser beam, passing through the first lens, produces a diverging ring-shaped beam and the diverging ring-shaped beam, passing through the second lens, produces a ring-shaped collimated laser beam.

15. The method of claim 14, wherein the particular internal angle and the particular aspect ratio determines an inner diameter of the ring-shaped collimated laser beam, an outer diameter of the ring-shaped collimated laser beam, and an eccentricity of the ring-shaped collimated laser beam.

16. The method of claim 11, wherein the work string is an overshot tool and the method further comprises:

latching the overshot tool on to the downhole equipment; and pulling the overshot tool, the laser tool, and the downhole equipment out of the wellbore.

17. The method of claim 16, wherein the ring-shaped collimated laser beam is able to be positioned to cut the downhole equipment.

18. The method of claim 16, wherein the laser tool further comprises:

fiber optics;

a laser head housing;

a cover lens;

a first lens; and a second lens, wherein a raw laser beam, emitted from the fiber optics, passes through the first lens and the second lens to generate a collimated laser beam whereby the laser head housing, along with the cover lens, protects the first lens and the second lens.

19. The method of claim 18, wherein the means for generating the ring-shaped collimated laser beam further comprises:

the first lens being a conic lens of a particular internal angle and a particular aspect ratio; and the second lens being the conic lens of the particular internal angle and the particular aspect ratio, wherein the raw laser beam, passing through the first lens, produces a diverging ring-shaped beam and the diverging ring-shaped beam, passing through the second lens, produces the ring-shaped collimated laser beam.

20. The method of claim 19, wherein the particular internal angle and the particular aspect ratio determines an inner diameter of the ring-shaped collimated laser beam, an outer diameter of the ring-shaped collimated laser beam, and an eccentricity of the ring-shaped collimated laser beam.

* * * * *